US009741296B2

(12) United States Patent
Takahashi et al.

(10) Patent No.: US 9,741,296 B2
(45) Date of Patent: Aug. 22, 2017

(54) DRIVING METHOD OF A DISPLAY DEVICE, AND A DISPLAY DEVICE

(71) Applicant: Japan Display Inc., Tokyo (JP)

(72) Inventors: Hideyuki Takahashi, Tokyo (JP); Masakatsu Kitani, Tokyo (JP); Seiichi Sato, Tokyo (JP); Masato Nakamura, Tokyo (JP); Koji Yamamoto, Tokyo (JP)

(73) Assignee: Japan Display Inc., Tokyo (JP)

( * ) Notice: Subject to any disclaimer, the term of this patent is extended or adjusted under 35 U.S.C. 154(b) by 71 days.

(21) Appl. No.: 14/847,672

(22) Filed: Sep. 8, 2015

(65) Prior Publication Data

US 2016/0071471 A1 Mar. 10, 2016

(30) Foreign Application Priority Data

Sep. 10, 2014 (JP) ..... 2014-184355

(51) Int. Cl.
*G09G 3/36* (2006.01)

(52) U.S. Cl.
CPC ..... *G09G 3/3607* (2013.01); *G09G 3/3614* (2013.01); *G09G 3/3648* (2013.01)

(58) Field of Classification Search
CPC combination set(s) only.
See application file for complete search history.

(56) References Cited

U.S. PATENT DOCUMENTS

2005/0275610 A1* 12/2005 Roh ..... G09G 3/3614 345/88
2009/0322802 A1* 12/2009 Noguchi ..... G09G 3/2003 345/694
2016/0062196 A1* 3/2016 Takahashi ..... G09G 3/36 349/43
2016/0071471 A1* 3/2016 Takahashi ..... G09G 3/3607 345/690
2016/0104448 A1* 4/2016 Lee ..... G09G 5/02 345/205

FOREIGN PATENT DOCUMENTS

JP 2010-33014 2/2010

* cited by examiner

*Primary Examiner* — Van Chow
(74) *Attorney, Agent, or Firm* — Oblon, McClelland, Maier & Neustadt, L.L.P.

(57) ABSTRACT

According to one embodiment, three columns of a first and second columns of first and second color pixels, and a third column of third and fourth color pixels arranged alternately, are repeatedly provided along a first direction. The first set of a first, a second and a third color pixels along the first direction, and the second set of a first, a second and a fourth color pixels along the first direction are each defined as a composite color unit pixel. Pixel signals are supplied to the pixels of the third columns in a pattern that polarities of the pixel signals of the pixels of the third columns along the first direction are . . . , +, +, −, −, +, +, −, −, +, +, −, −, . . . .

12 Claims, 8 Drawing Sheets

DRIVING METHOD OF A DISPLAY DEVICE, AND A DISPLAY DEVICE

CROSS-REFERENCE TO RELATED APPLICATIONS

This application is based upon and claims the benefit of priority from Japanese Patent Application No. 2014-184355, filed Sep. 10, 2014, the entire contents of which are incorporated herein by reference.

FIELD

Embodiments described herein relate generally to a driving method of a display device, and a display device.

BACKGROUND

In a liquid crystal display device of color display, a plurality of pixels are arranged in a first direction (X direction) and a second direction (Y direction). The first direction (X direction) intersects the second direction (Y direction). Each pixel comprises a color filter and operates as a red pixel (R), a green pixel (G) or a blue pixel (B).

In recent years, a technique of improving display luminance of a liquid crystal display has been proposed. As an example, a red pixel (R), a green pixel (G), a blue pixel (B) and a white pixel (W) are arranged in a predetermined order along the first direction, and this one set constitutes one composite color unit pixel. A white pixel (W) has a higher efficiency of use of light as compared to a red pixel (R), a green pixel (G) or a blue pixel (B), and the transmissivity of is about three times that of a red pixel (R), a green pixel (G), and a blue pixel (B). Therefore, if a white pixel (W) is used in a composite color unit pixel, the brightness of the display device can be raised.

Liquid crystal display devices employ a liquid crystal drive mode in order to improve the liquid-crystal drive efficiency. More specifically, pixel columns of each adjacent pair are driven by drive voltage of different polarities, and the polarity is inverted from one frame to another. This drive mode is called a column inversion driving mode.

DETAILED DESCRIPTION

Various embodiments will be described hereinafter with reference to the accompanying drawings.

As a liquid crystal driving mode, the column inversion driving mode is effective when the composite color unit pixels of a liquid crystal display are formed three color pixels of a red pixel (R), a green pixel (G) and a blue pixel (B). But when the composite color unit pixel is formed of four color pixels of a white pixel (W), a red pixel (R), a green pixel (G), and a blue pixel (B), the polarity inversion in the color pixels may not be carried out properly by the conventional column inversion driving mode. For example, let us suppose the case where the first and second blue pixels (B) are arranged in different columns and pixel signals supplied to these pixels are of the same level. In this case, the voltage polarity of the pixel signals supplied to the first and second blue pixels (B) are not inverted between columns (column inversion) and therefore, the voltages of the pixel signals are not balanced (equalized). As a result, for example, the reference voltage of the common electrode may be biased toward a positive or negative side. The blue pixels (B) thus biased cause adverse effect on the accurate color reproduction of an image.

As a solution, according to this embodiment, there is provided a liquid crystal display which can properly obtain the effect of polarity-inversion driving of color pixels, thus enabling to improve the color reproduction performance power.

In the display device of this embodiment, a set of three columns, namely, a first column of red (first color) pixels, a second column of green (second color) pixels and a third column of blue (third color) pixels and white (fourth color) pixels alternately arranged, is repeatedly provided in the first direction, and a first set of a red (first color) pixel, a green (second color) pixel and a blue (third color) pixel arranged along the first direction, and a second set of a red (first color) pixel, a green (second color) pixel and a white (fourth color) pixel are each defined as a composite color unit pixel. Further, odd-numbered and even-numbered gate lines are provided for the arrangement of pixels to correspond to the odd-numbered and even-numbered rows, respectively.

The driving method comprises, supplying pixel signals to the pixels of the third columns in a pattern that polarities of the pixel signals of the pixels of the third columns along the first direction with respect to the common electrode are: . . . , positive(+), positive(+), negative(−), negative(−), positive(+), positive(+), negative(−), negative(−), positive(+), positive(+), negative(−), negative(−), . . . .

Embodiments will be further described with reference to the drawings.

Note that throughout the drawings, structural members which exhibit identical or similar functions are designated by the same referential symbols, and explanations therefor will not be repeated.

Figure 1:
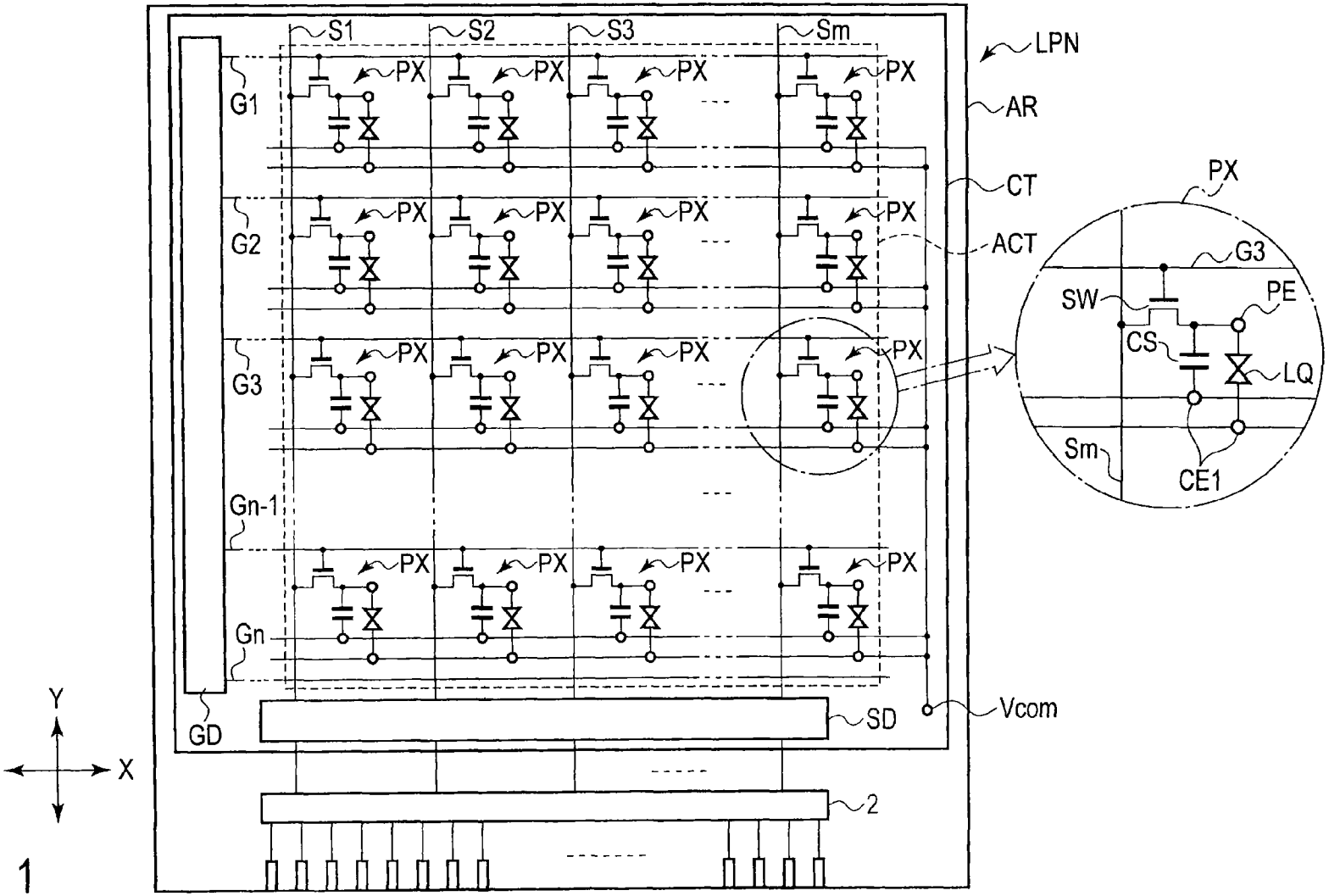
FIG. 1 is a diagram briefly showing a structure of a liquid crystal display panel LPN which is a part of a display device of this embodiment, and an equivalent circuit thereof.

FIG. 1 briefly shows a structure of a liquid crystal display panel LPN which is a part of a display device of this embodiment, together with an equivalent circuit thereof.

The display device comprises an active-matrix liquid crystal display panel LPN. The liquid crystal display panel LPN comprises an array substrate AR as a first substrate, a counter-substrate CT as a second substrate, opposing the array substrate AR, and a liquid crystal layer LQ held between the array substrate AR and the counter-substrate CT.

The liquid crystal display panel LPN comprises an active area ACT (area enclosed by a dotted line in the figure)

configured to display images. The active area ACT corresponds to a region where the liquid crystal layer LQ is held between the array substrate AR and the counter-substrate CT, having, for example, a quadrangular shape, and comprises a plurality of pixels PXs arranged in a matrix.

The array substrate AR comprises, in the active area ACT, a plurality of gate lines G (G1 to Gn) extending along the first direction X, and source lines S (S1 to Sm) extending along the second direction Y which intersects the first direction X.

As shown in the right-hand side of the figure as a typical example (region enclosed by an alternate long and short dash line), each pixel PX comprises a switching element SW electrically connected to a respective gate line G and a respective source line S, a pixel electrode PE electrically connected to the switching element SW (in each pixel PX), a common electrode CE1 opposing the pixel electrode PE, etc. According to the figure, there are apparently two common electrodes present, but in reality, there is only one integrated common electrode CE1. A storage capacitance CS is formed, for example, between the common electrode CE1 and the pixel electrode PE. On the other hand, the counter-substrate CT is set to oppose the array substrate AR with the liquid crystal layer LQ therebetween.

Each gate line G is led outside of the active area ACT and is connected to a first driving circuit GD. Each source line S is led outside of the active area ACT and is connected to a second driving circuit SD. The first driving circuit GD and the second driving circuit SD are, for example, at least partially formed on the array substrate AR and are connected to a driving IC chip (referred to as a liquid crystal driver in some cases) 2.

The second driving circuit SD is configured to output pixel signals of different polarities to source lines of columns adjacent to each other in order to realize the column-inversion drive scheme.

The driving IC chip 2 includes a built-in controller configured to control the first driving circuit GD and the second driving circuit SD, and functions as a signal supply source to supply signals required to drive the liquid crystal display panel LPN.

In the example illustrated, the driving IC chip 2 is mounted on the array substrate AR outside of the active area ACT of the liquid crystal display panel LPN.

The common electrode CE1 extends over the entirety of the active area ACT, and is formed in common to a plurality of pixels PXs. The common electrode CE1 is led outside of the active area ACT, and is connected to a power supply module Vcom. The power supply module Vcom is formed on the array substrate AR, for example, outside of the active area ACT, and is electrically connected to the common electrode CE1. A constant common voltage is supplied to the power supply module Vcom.

Color filters are arranged at a predetermined rule on the pixels PXs. Each color filter is formed on the counter-substrate CT while opposing a pixel electrode with the liquid crystal layer LQ therebetween.

Figure 2:
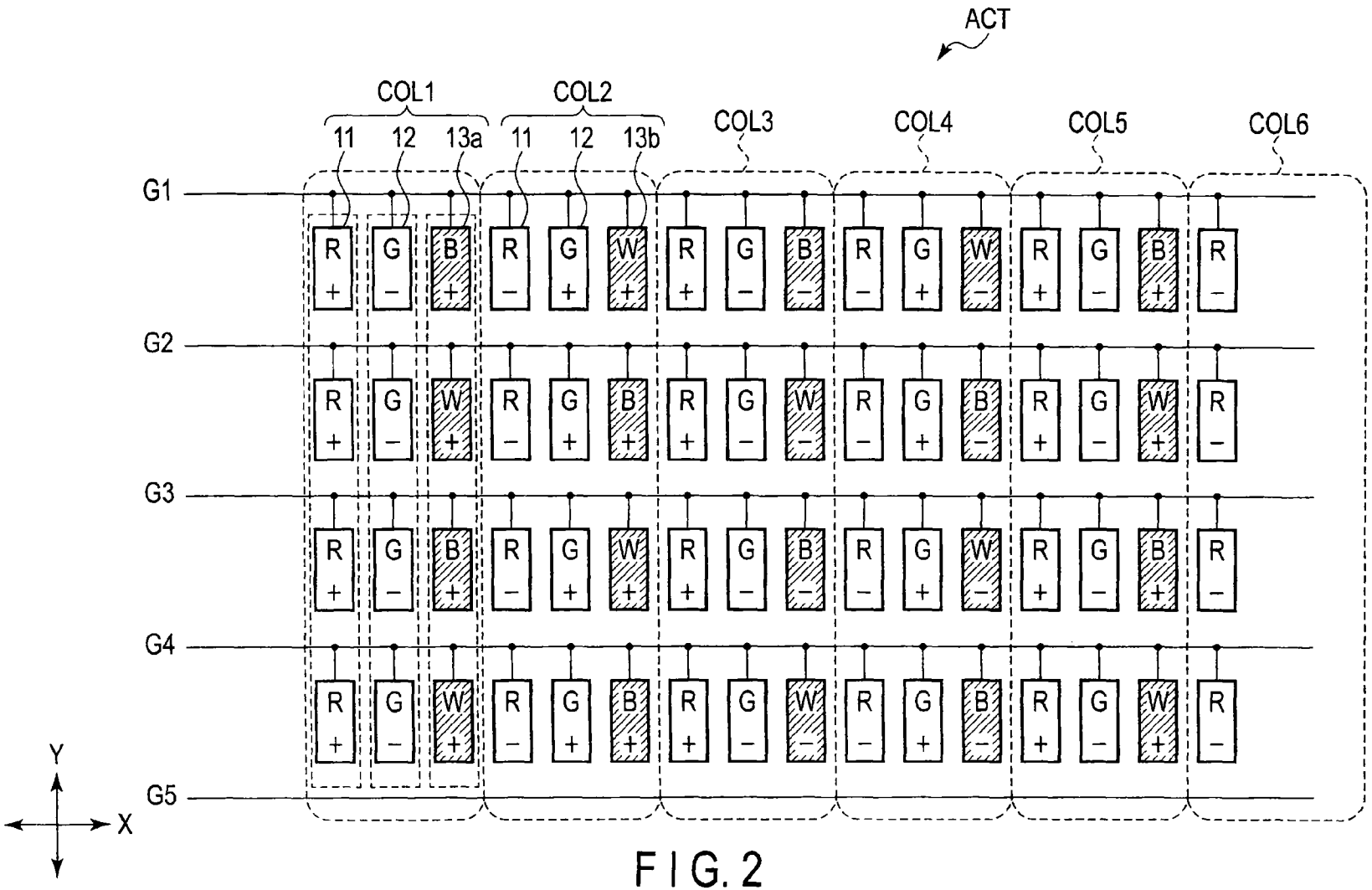
FIG. 2 is a diagram showing an example of color filters arranged on the pixels PX.

FIG. 2 shows an example of the arrangement of colored filters for the pixels PX. A pixel integrated with a respective color filter will be hereinafter called a color pixel, and those integrated with red, green, blue and white filters will be called a red (first color) pixel (R), a green (second color) pixel (G), a blue (third color) pixel (B) and a white (fourth color) pixel (W), respectively.

In this embodiment, a first column 11 of red (first color) pixels, a second column 12 of green (second color) pixels, and a third column 13*a* or 13*b* which occurs alternately between blue (third color) pixel and white (fourth color) pixel are repeatedly provided along the first direction. Note that the third column is denoted by one of two types of reference numerals, 13*a* and 13*b*, in which a blue pixel (B) and a white pixel appear alternately, and in one type, blue pixels (B) are provided in odd-numbered rows and white pixels (W) are provide in even-numbered rows, whereas in the other type, white pixels (W) are provided in odd-numbered rows and blue Pixels (B) are provided in even-number lows as the arrangement rule.

Further, in this embodiment, a set of the red pixel (R), green pixel (G) and blue pixel (B) and a set of the red pixel (R), a green pixel (G) and a white pixel (W), arranged along the first direction, are each define as a composite color unit pixel. In the figure, columns of composite color unit pixels are designated by reference signs, COL1, COL2, COL3, COL4, . . . . The columns COL1, COL2, COL3, COL4, . . . , of the composite color unit pixels each include the first column 11, the second column 12 and the third column 13*a* (or 13*b*).

Next, gate lines G1, G2, G3, G4, . . . , are provided along the first direction to correspond to the respective rows of pixels.

Gates of the pixels of the odd-numbered row are connected to the odd-numbered gate lines G1, G3, G5, . . . , and gates of the pixels of the even-numbered rows are connected to the even-numbered gate lines G2, G4, G6, . . . .

In the display device with the structure described above, pixel signals are supplied from a second drive circuit SD. In this case, the column-inversion drive scheme is performed. For example, the polarity (+or −) of the pixel signal is indicated for each color pixel in FIG. 2.

In this embodiment, the pixels are driven so that the polarities of the pixel signals of the pixels (blue pixels and white pixels) of the third column, with respect to the common electrode, include the following pattern in the first direction, . . . +, +, −, −, +, +, −, −, +, +, −, − . . . , positive/positive/negative/negative/positive/positive/negative/negative . . . ). Here, supposing the potential of the common electrode is 0V, the pixel signals along the first direction are output, for example, as . . . +5V, +5V, −5V, −5V, +5V, +5V, −5V, −5V, +5V, +5V, −5V, −5V, . . . .

The above-described method exhibits the following advantageous effect. Let us focus on the writing of pixel signals to columns of red pixels (R), for example. Here, when, for example, the gate line G1 is on, with respect to the first direction, a positive potential is written to those of odd-numbered columns, and a negative potential is written to those of even-numbered columns. In the example shown in FIG. 2, a pixel signal of a positive potential is written in the red pixels (R) of odd-numbered columns COL1, COL3, COL5, . . . , and a pixel signal of a negative potential is written in the red pixels (R) of even-numbered column COL2, COL4, COL6, . . . . Therefore, along the first direction, the polarities of the red pixels (R) with respect to the common electrode regularly flip as +, −, +−, . . . . In this manner, the polar balance of the common electrode for the red color is not biased to one of polarity. In other words, in the write-in processing of a pixel signal to the red pixels, the potential of the common electrode is not biased to the positive or negative direction.

The above is also the same with the case for the write-in processing of a pixel signal to green pixels (G). More specifically, in terms of the first direction, for example, when the gate line G1 is on, with respect to the first direction, a negative potential is written to those of odd-numbered columns, and a positive potential is written to those of even-numbered columns. In the example shown in FIG. 2, a pixel signal of a negative potential is written to the green pixels (G) of odd-numbered columns COL1, COL3, COL5, . . . , and a pixel signal of a positive potential is written in the green pixels (G) of even-numbered column COL2, COL4, COL6, . . . .

Thus, in the green pixels (G) along the first direction, the polarity flips regularly as −, +, −, +, −, . . . . In this manner, the polarity of the common electrode for the green pixels (G) is not biased to one of polarity. In other words, in the pixel-signal writing-in processing for the green color, the potential of the common electrode is not biased to the positive or negative direction.

Next, the write-in processing of a pixel signal to blue pixels (B) will now be focused. For example, in terms of the first direction, when the gate line G1 is on, a pixel signal of a positive potential is written in the blue pixels (B) of columns COL1, COL5, COL9 (not shown), . . . , whereas a pixel signal of a negative potential is written in the blue pixels (B) of columns COLS, COL7 (not shown), COL11 (not shown), . . . .

When the pixel signals are written in the blue pixels (B) based on the above-described regulation regarding the polarity, the polarity flips regularly as . . . +, −, +, −, . . . along the first direction, and thus the polarities with respect to the common electrode are equalized. Thus, as to the pixel signal-write-in processing for the blue color, the potential of the common electrode is not biased to the positive or negative polarity.

Further, the write-in processing of a pixel signal to white pixels (W) will now be focused. For example, in terms of the first direction, when the gate line G1 is on, a pixel signal of a positive potential is written in the white pixels (W) of columns COL2, COL6, COL10 (not shown), . . . , whereas a pixel signal of a negative potential is written in the white pixels (W) of columns COL4, COL8 (not shown), COL12 (not shown), . . . .

When the pixel signals are written in the white pixels (W) based on the above-described regulation regarding the polarity, the polarity flips regularly as . . . +, −, +, −, . . . along the first direction, and thus the polarities with respect to the common electrode are equalized. Thus, as to the pixel signal-write-in processing for the white color, the potential of the common electrode is not biased to the positive or negative polarity.

Figure 3:
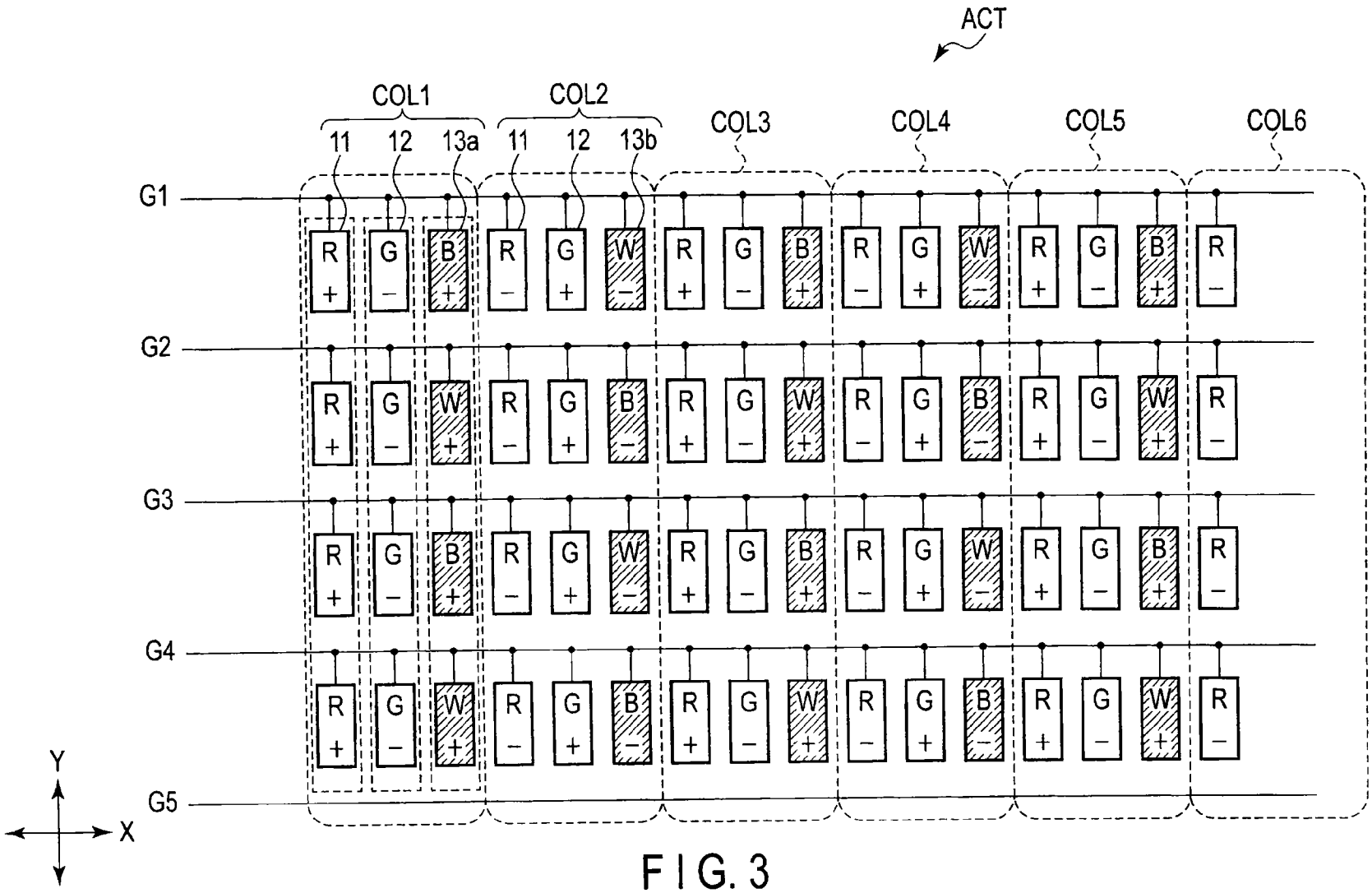
FIG. 3 is a diagram showing another example of the colored filter to be compared with the color filter of FIG. 2.

FIG. 3 shows the connection between the pixels and gate lines when such measures as shown in FIG. 2 are not taken. In such connection, the connection between the gate lines and the red pixels (R) or green pixels (G) is the same as that of the example shown in FIG. 2 and therefore the polarity of the common electrode is the same as that of the example of FIG. 2. Therefore, an explanation therefor is omitted.

But in this connection, in terms of the first direction, for example, when the gate line G1 is on, a pixel signal of a potential of a positive side with respect to that of the common electrode is written in the blue pixels (B) of columns COL1, COL3, and COL5. Here, when the gate line G1 is on, in terms of the first direction, there is no pixel signal of a negative potential written for the blue color. Therefore, in the case of the structure of FIG. 3, the polarity of the common electrode for the blue color is biased toward the polarity of the positive side. Further, as to the blue pixels (B) connected to the gate line G2, the polarity of the common electrode for the blue color is biased toward the polarity of the negative side.

In the structure of FIG. 3, a similar view to that of the blue pixels (B) discussed above can be applied to the case of white pixels (W). That is, the polarity of the common electrode for the white color is biased.

In contrast, in the case of the structure discussed with reference to FIG. 2, the reference potential of the common electrode is stable for each of the color pixels (R), (G), (B) and (W).

Figure 4:
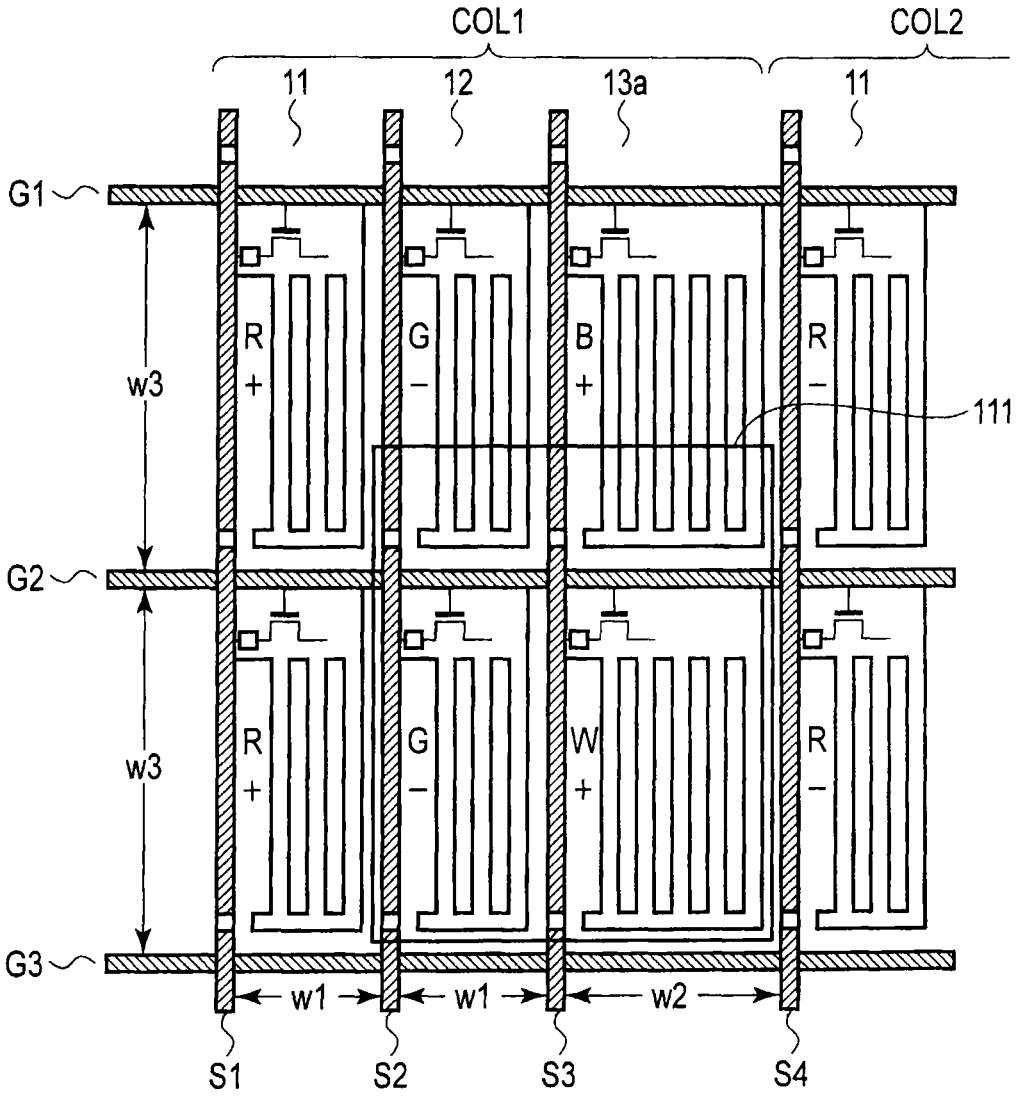
FIG. 4 is a diagram showing a more detailed structure of columns COL1 and COL2 of the composite color unit pixels shown in FIG. 2.

FIG. 4 shows a more detailed structure of columns COL1 and COL2 of the composite color unit pixels shown in FIG. 2. As compared with FIG. 2, FIG. 4 further illustrates the structure of each pixel electrode, gate lines G1, G2 and G3 and source lines S1 to S4. Also, FIG. 4 briefly shows pixel electrodes and the connections between source lines and gate lines of the respective pixel electrodes.

A pixel electrode is connected to a respective source line by a respective switching element formed in the connection portion. The switching element is on/off-controlled by a control signal from the gate line. The structure of the connection portion will be described later with reference to FIG. 5A and FIG. 5B.

As shown in FIG. 4, in this embodiment, for the composite color unit pixels, four types of color pixels of white pixel (W), red pixel (R), green pixel (G) and blue pixel (B) are used. But if a set of four color pixels of a white pixel (W), a red pixel (R), a green pixel (G) and a blue pixel (B) simply arranged along the first direction is defined as one composite color unit pixel, the pitch of arrangement of the composite color unit pixels becomes large, thus degrading the resolution. To avoid this, in this embodiment, the composite color unit pixels of columns COL1, COL2, COL3, COL4, . . . , are arranged in a basic unit of three-color pixels, respectively, in the first column 11, the second column 12 and the third column 13*a* (or 13*b*), as described with reference to FIG. 2. With this arrangement, the degradation of resolution is suppressed.

Further, in this embodiment, in the sequence of composite color unit pixels in the first direction, a set of a red pixel (R), a green pixel (G) and a blue pixel (B) and a set of a red pixel (R), a green pixel (G) and a white pixel (W) are repeatedly provided alternately. Let us suppose here that, for example, composite color unit pixels ((3×2) pixels) of two rows are combined. A set of a red pixel (R), a green pixel (G) and a blue pixel (B) and a set of a red pixel (R), a green pixel (G) and a white pixel (W) are provided.

Thus, in this embodiment, a two-dimensional array, (3×2), of six color unit pixels (two red pixels (R), two green pixels (G), one blue pixel (B) and one white pixel (W)) are combined as needed to devise color reproduction. That is, in order to make it easier to balance in brightness between the colors, the above-structure is designed so that the area of two red pixels (R), the area of two green pixels (G), and the area of one blue pixel (B) become equal. Therefore, with this structure, it is not necessary to concern the unbalance of the color filter areas in the signal-processing method for performing color reproduction based on red pixels (R), green pixels (G) and blue pixels (B). Here, as for the signal supplied to white pixels (W), the gain is set according to the object of adjustment in luminance and lightness.

It is designed that the area of one blue pixel (B) is substantially equally to a total area of two red pixels (R) (=total area of two green pixels (G)) as described above. Therefore, in terms of the first direction, as compared to a width w1 of a red pixel (R) and a green pixel (G), a width w2 of a white pixel (W) and a blue pixel (B) is greater. Note that widths w3 of gaps between adjacent pairs of gate lines along the first direction are the same as each other.

FIG. 4 briefly shows the connections between pixels, gate lines and source lines. The connection portions will now be described in detail.

Figure 5A:
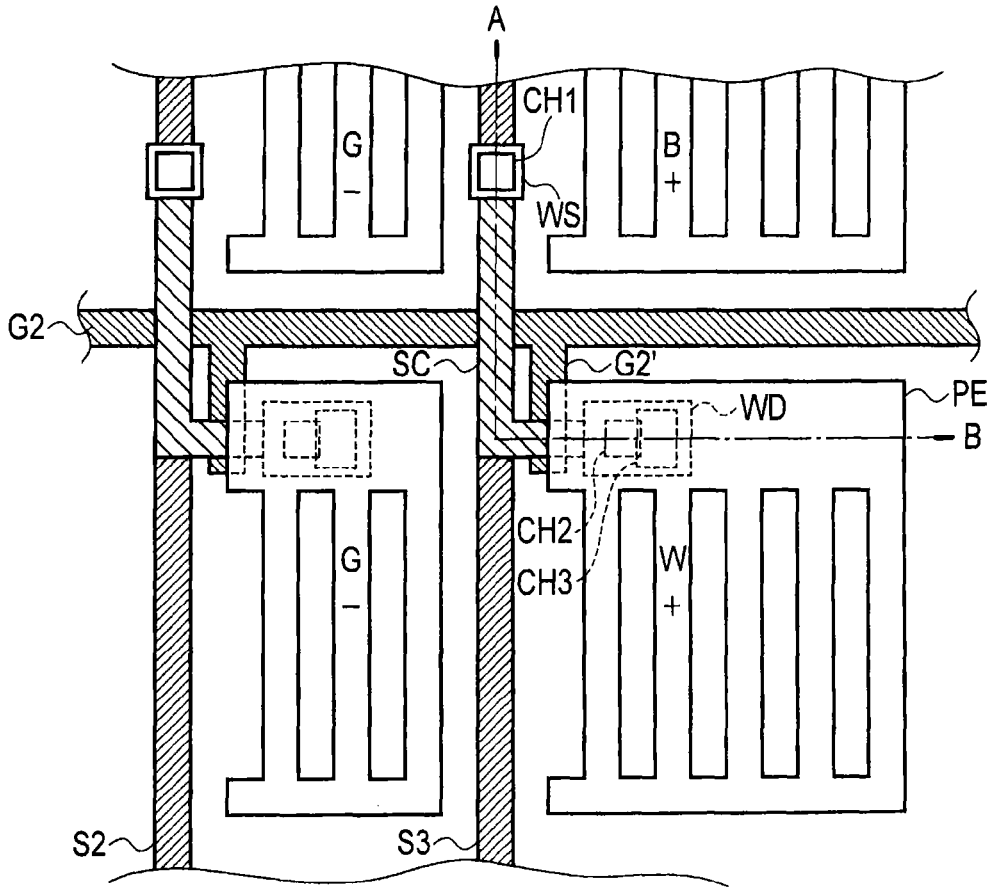
FIG. 5A is an extracted diagram of a section 111 enclosed with a square in FIG. 4.
Figure 5B:
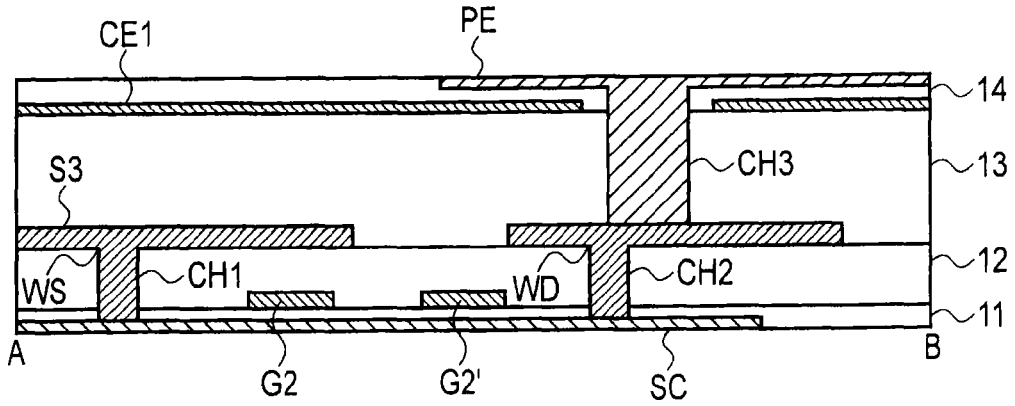
FIG. 5B is a schematic diagram showing a cross-section of the device taken along line A-B in FIG. 5A.

FIG. 5A and FIG. 5B are each an extracted diagram showing a portion 111 enclosed by a quadrangle shown in FIG. 4. FIG. 5A is an enlarged view showing a neighborhood of source lines S2 and S3 and gate line G2. FIG. 5B is a schematic cross section of the device of FIG. 5A taken along line A-B. That is, the region of the white pixel (W) connected to the gate line G2 will be described in detail.

In this embodiment, a fringe field switching (FFS) system is employed, in which pixel electrodes are each formed to include a slit and the liquid crystal molecules are driven between pixel electrodes and a common electrode.

The source line S3 is located between an insulating layer 12 and an insulating layer 13. Beneath the source line S3, a semiconductor layer SC is formed via the insulating layers 12 and 11 therebetween. A source electrode WS connected to a part of the source line S3 is connected to a source of the semiconductor layer SC through a contact hole CH1. The semiconductor layer SC extends over beneath the source line S3, passes over beneath the gate line G2 and enters the region of the white pixel (W). The portion of the semiconductor layer SC which enters the region of the white pixel (W) is used as a drain.

The gate line G2 is located between the insulating layer 11 and the insulating layer 12 beneath the layer of the source line S3. A portion of the gate line G2 projects to the pixel formation region, and this portion is denoted by reference G2' in the figure.

The drain of the semiconductor layer SC is connected to a drain electrode WD through a contact hole CH2 made through the insulating layers 11 and 12. Further, the drain electrode WD is connected to the pixel electrode PE through a contact hole CH3 made through an insulating layer 13, a common electrode CE1 and an insulating layer 14. Note that the common electrode CE1 shown in FIG. 5B is not illustrated in FIG. 5A.

The pixel electrode and the source line of the white pixel (W) are connected as shown in FIG. 5A, which will now be described. That is, the source electrode of the switching element SC is connected to the source line S3 through a first contact hole CH1, and the drain electrode of the switching element SC is connected to the pixel electrode PE through a second contact hole CH2. Here, the first contact hole CH1 formed in the source line S3 and the second contact hole CH2 beneath the pixel electrode PE are located in rows adjacent to each other.

With the above-described arrangement, the contact hole for connecting the source electrode of the switching element to the source line and the contact hole for connecting the drain electrode of the switching element to the pixel electrode are located in different rows. In this manner, the degree of overcrowding of contact holes can be reduced, which enables to improve the reliability of the manufacture of the devices.

If a contact hole for connecting the source electrode of a switching element to a respective source line is located in the same column as that of a contact hole for connecting the drain electrode of a switching element to a respective pixel electrode, the density of contact holes becoming high. As a result, such a necessity arises that the accuracy of the manufacture of the devices should be improved, and also the risk of defective products being produced will become high. According to the designing of this embodiment, the degree of overcrowding of contact holes can be reduced and thus the reliability of the manufacture of the devices can be improved. That is, the contact holes can be dispersed (overcrowding being reduced), and the accuracy required for the manufacture of the devices can be relaxed. Thus, the yield of manufacture of the devices can be improved.

Figure 6:
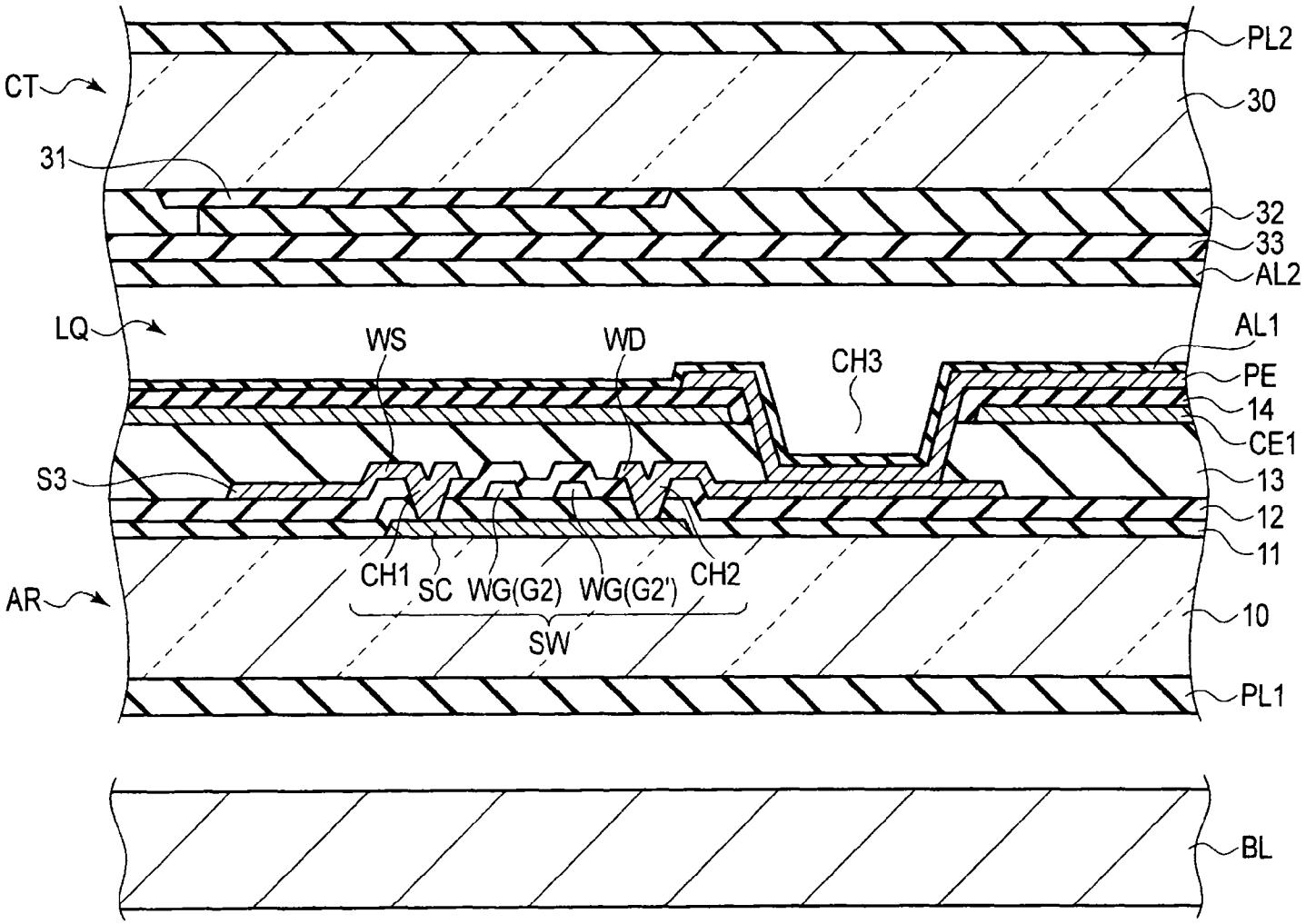
FIG. 6 is a more detailed diagram showing the section of FIG. 5B.

FIG. 6 briefly shows a cross-sectional structure of a surrounding of the connection portion including the switching element (SW) shown in FIGS. 5A and 5B.

The array substrate AR is formed from the first insulating substrate 10 having light transmissivity, such as a glass substrate and a resin substrate. The array substrate AR comprises a switching element SW, a first common electrode CE1, a pixel electrode PE, a first insulating layer 11, a second insulating layer 12, a third insulating layer 13, a fourth insulating layer 14, a first perpendicular alignment film AL1 and the like. Note that the first perpendicular alignment film AL1 may be a horizontal alignment film.

In the illustrated example, the switching element SW is a top-gate thin film transistor. The switching element SW comprises a semiconductor layer SC provided on the first insulating substrate 10. Note that an undercoat layer, which is an insulating layer, may be interposed between the first insulating substrate 10 and the semiconductor layer SC.

The semiconductor layer SC is covered by the first insulating layer 11. The first insulating layer 11 is located also on the first insulating substrate 10. The first insulating layer 11 is formed of an inorganic material such as tetraethoxysilane (TEOS).

The gate electrode WG of the switching element SW is formed on the first insulating layer 11 and is located immediately above the semiconductor layer SC. The gate electrode WG is electrically connected to gate lines G2 and G2' (or formed integrally with the gate lines) and is covered by the second insulating layer 12. The second insulating layer 12 is located also on the first insulating layer 11. The second insulating layer 12 is formed of an inorganic material such as silicon nitride.

The source electrode WS and the drain electrode WD of the switching element SW are formed on the second insulating layer 12. Similarly, the source line S3 is formed on the second insulating layer 12. The source electrode WS illustrated in the figure is electrically connected to the source line S3 (or formed integrally with the source line S3). The source electrode WS and the drain electrode WD are in contact with the semiconductor layer SC through the contact holes CH1 and CH2 which penetrate the first insulating layer 11 and the second insulating layer 12, respectively. The switching element SW is covered by the third insulating layer 13 with the source line S3. The third insulating layer 13 is located also on the second insulating layer 12. The third insulating layer 13 is formed of a transparent resin material, for example.

The common electrode CE1 extends on the third insulating layer 13. As shown, the common electrode CE1 covers the source line S3 from above, and extends towards an adjacent pixel. The common electrode CE1 is formed of a transparent conductive material such as indium tin oxide (ITO) or indium zinc oxide (IZO). The fourth insulating layer 14 is provided on the common electrode CE1.

A contact hole CH3 is formed in the third insulating layer 13 and the fourth insulating layer 14 so as to penetrate even to the drain electrode WD. The fourth insulating layer 14 is formed thinner as compared to that of the third insulating layer 13 and is formed of an inorganic material such as silicon nitride. The fourth insulating layer 14 is equivalent to an interlayer insulation film which covers the common electrode CE1.

The pixel electrode PE having a slit is formed on the fourth insulating layer 14 such as to oppose the first common electrode CE1. The pixel electrode PE is electrically connected to the drain electrode WD of the switching element SW through the contact hole CH3. The pixel electrode PE is formed of, for example, a transparent conductive material such as ITO or IZO. The pixel electrode PE is covered by the first perpendicular alignment film AL1.

On the other hand, the counter-substrate CT is formed from the second insulating substrate 30 having light transmissivity, such as a glass substrate or a resin substrate. The counter-substrate CT comprises, on a side of the second insulating substrate 30, which opposes the array substrate AR, a light-shielding layer 31, a color filter 32, an overcoat layer 33, a second perpendicular alignment film AL2 and the like.

The light-shielding layer 31 partitions the pixels PX in the active area ACT and forms an opening. The light-shielding layer 31 is provided in the boundary between color pixels or in a position which opposes the source line formed on the array substrate AR. The light-shielding layer 31 is formed of a light-blocking metal material or a black resin material.

The color filter 32 is formed on an aperture and a part thereof overlaps the light-shielding layer 31. In the example shown here, the color filter 32 is, for example, white and formed of a color-free resin material. In the case of a red filter, a resin material colored red is used. Similarly, in the case of a green filter, a resin material colored green is used, and for a blue filter, a resin material colored blue is used.

The red filter is provided on a red pixel (R) which displays red, the green filter is provided on a green pixel (G) which displays green, and the blue filter is provided on a blue pixel (B) which displays blue. Further, a white (or transparent) filter is provided on a white pixel (W) which displays white. Note that a color filter may not be provided for a white pixel (W). Moreover, the white filter may not be an absolutely colorless filter, but may be a pale color filter (for example, in thin yellow). The boundary between color filters of different colors is located in a position which overlaps with the light-shielding layer above the respective source line.

The overcoat layer 33 covers the color filter 32. The overcoat layer 33 planarizes surface roughness of the light-shielding layer 31 or the color filter 32.

The overcoat layer 33 is formed of a transparent resin material. The overcoat layer 33 is used as a base and covered by the second perpendicular alignment film AL2.

The first perpendicular alignment film AL1 and the second perpendicular alignment film AL2 are each formed of a material which exhibits perpendicular alignment properties, and have the alignment regulating power to align liquid crystal molecules in a normal direction to the substrate without requiring an alignment process such as rubbing.

The array substrate AR and the counter-substrate CT described above are arranged so that the first perpendicular alignment film AL1 and the second perpendicular alignment film AL2 face each other. Between the array substrate AR and the counter-substrate CT, a predetermined cell gap is formed of a pillar-shaped spacer formed on one of the substrates. The array substrate AR and the counter-substrate CT are attached together with a sealing material while the cell gap being formed therebetween. The liquid crystal layer LQ is filled in the cell gap between the first perpendicular alignment film AL1 and the second perpendicular alignment film AL2.

A backlight BL is provided on a back side of the liquid crystal display panel with the above-described structure. As the backlight BL, various types are applicable, but an explanation on the detailed structure thereof is omitted.

On an external surface of the first insulating substrate 10, a first optical element comprising a first polarizer PL1 is provided. On an external surface of the second insulating substrate 30, a second optical element comprising a second polarizer PL2 is provided. The first polarizing plate PL1 and the second polarizing plate PL2 are arranged, for example, in a crossed-Nicol positional relationship in which the polarization axes are perpendicular to each other.

In the above-described embodiment, the first set of a red (first color) pixel, a green (second color) pixel and a blue (third color) pixel, and the second set of a red (first color) pixel, a green (second color) pixel and a white pixel (fourth color) are each defined as a composite color unit pixel. In this display device, odd-numbered gate lines and even-numbered gate lines are arranged for composite color unit pixels arranged in odd-numbered rows and even-numbered rows, respectively. Here, with the arrangement of the blue pixels and the white pixels along the first direction, the polarity pattern of the pixel signals with reference to the common electrode includes, in the first direction, . . . ++−−++−−++−− . . . . These polarities are set by the second driving circuit SD.

Figure 7:
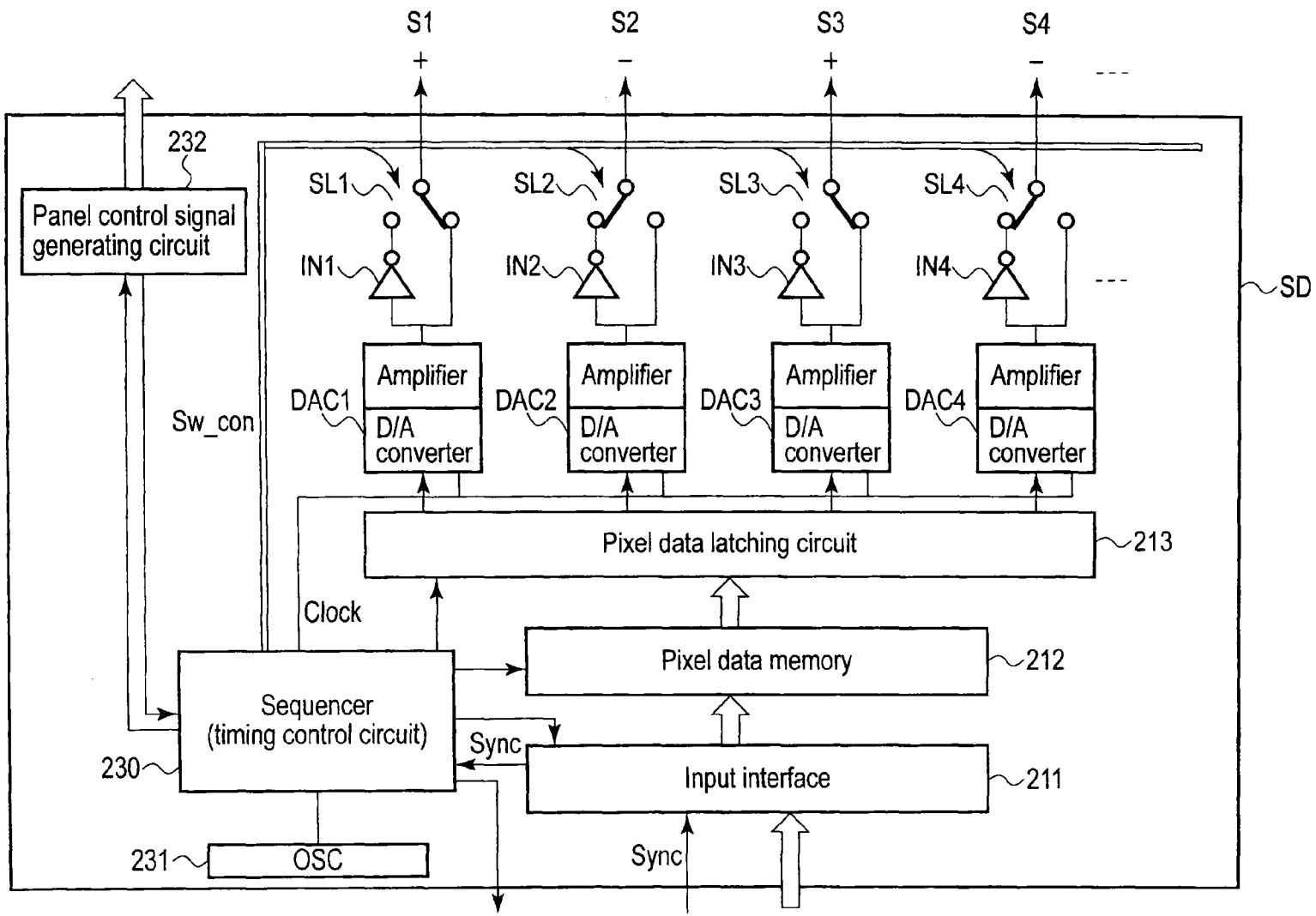
FIG. 7 is a diagram showing an example of the second driving circuit shown in FIG. 1.

FIG. 7 shows an examples of the structure of the driving IC chip 2 (note that the name of this member is not limited to this, but it may be referred to as a driver, liquid crystal driver, a controller or the like) which realizes the column-inversion drive scheme. To explain, an input interface 211 receives display data and an external synchronization signal Sync from an external application processor. The external synchronizing signal Sync is inputted into a sequencer 230, and the sequencer 230 generates various kinds of timing pulses used in the drive IC chip 2 in synchronism with the external synchronizing signal Sync.

The display data is input to a pixel data memory 212 from the input interface 211 and is temporarily stored therein. Pixel data for more than one row (more than one line) may be stored in the pixel data memory 212.

The pixel data for one row is output from the pixel data memory 212 and is latched in a pixel data latching circuit 213. The pixel data output from the pixel data latching circuit 213 is input to a D/A converter, where the data items are converted into analog pixel signals. The pixel signals are amplified by analog amplifiers and output to corresponding source lines S1, S2, S3 and S4. With reference to the figure, four series of source lines S1 to S4 are described as typical examples along with digital-to-analog converters DAC1 to DAC4.

As the pixel signals converted into analog, pixel signals of a positive polarity and those of negative polarity are prepared with respect to the common electrode. The pixel signals of the negative polarity are produced by inverters IN1 to IN4.

The polarity of the pixel signal to be output to each of the source lines S1 to S4 is determined by the polarity selection state of each of the switches SL1 SL4. In the illustrated example, the switch SL1 selects a pixel signal of the positive polarity for the source line S1. Further, the switch SL2 selects a pixel signal of the negative polarity for the source line S2. The switch SL3 selects a pixel signal of the positive polarity for the source line S3, and the switch SL4 selects a pixel signal of the negative polarity for the source line S4.

Control signals Sw_con for the switches SL1 to SL4 are generated by the sequencer 230. The sequencer 230 is configured to supply operation timing signals to the input interface 211, the image data memory 212, the pixel-data latching circuit 213 and the like. Further, the sequencer 230 can supply an internal clock to the digital-to-analog converters DAC1 to DAC4. The internal clock is produced using an oscillation output of an internal oscillator 231.

The sequencer 230 also supplies a timing signal to the panel control signal generating circuit 232. Based on the timing signal, the panel control signal generating circuit 232 is able to supply a drive timing pulse to the first driving circuit GD and the second drive circuit SD of the display panel.

Figure 8:
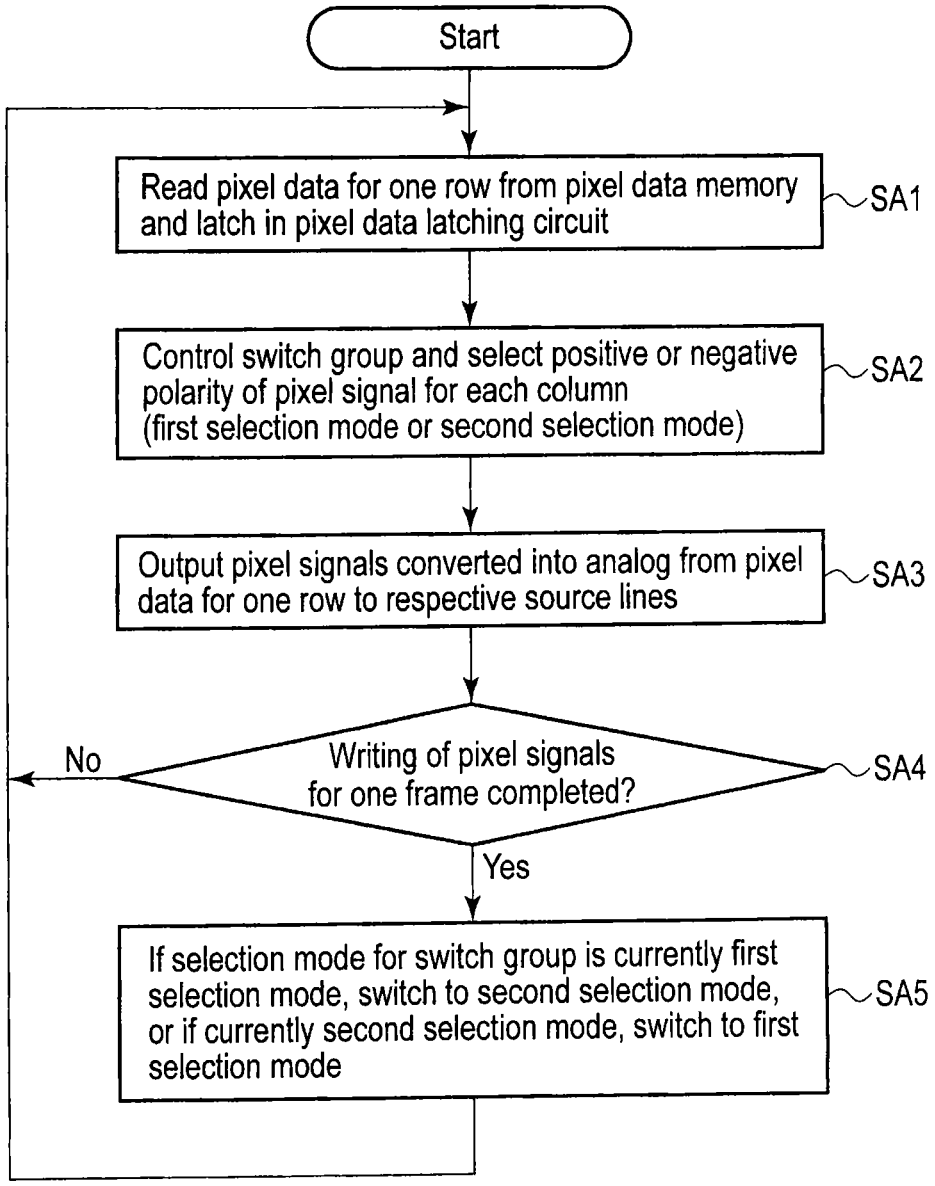
FIG. 8 is a diagram illustrating an example of a software program to execute an example of the operation of this embodiment.

FIG. 8 shows an example of the software program to execute an example of the operation of this embodiment. Pixel data for one row is read from the image data memory 212 and latched in the pixel data latching circuit 213 (step SA1). Next, the group of switches (SL1, SL2, . . . ) is controlled. Thus, the polarity (positive or negative) of the pixel signal to be output to each respective source line (S1, S2, . . . ) is set (step SA2). Next, the pixel data for one row is converted into analog data by the digital-to-analog converter (DAC1, DAC2, . . . ) and is output to each respective source line (S1, S2, . . . ) (step SA3).

Next, it is determined whether or not the output of pixel signals for one frame is completed (step SA4). If the output of the pixel signals for one frame is not completed, the process returns to step SA1. If completed, the process proceeds to the one following frame. In this case, the selection mode of the group of switches is currently the first selection mode (that is, as indicated in FIG. 2, the pattern of the first row along the second direction includes: R(+), G(−), B(+), R(−), G(+), W(+), R(+), G(−), B(−), R(−), G(+), W(−), . . . ), the selection mode is shifted from the first mode to the second mode (that is, the pattern of the first row along the second direction, now includes: R(−), G(+), B(−), R(+), G(−), W(−), R(−), G(+), B(+), R(+), G(−), W(+), . . . ) and the process returns to step SA1 (Step S5). In other words, when shifted from the first selection mode of the first frame to the second selection mode of the following frame, the polarity of each pixel is inverted. In this manner, in the first frame, the pixel signals of the pixels of the third columns, the polarities with respect to the common electrode along the first direction include a pattern of . . . positive/positive/negative/negative/positive/positive/negative/negative/positive/positive/negative/negative, . . . , whereas in the following second frame, the polarities of the pixel signals of the pixels of the third columns exhibit a pattern inverted to that of the first frame.

Note that the embodiments provided above are described in connection with the FFS mode, in which pixel electrodes comprise slits and liquid crystal molecules are driven between pixel electrodes and a common electrode. But, the embodiments are not limited to such a drive mode, and other systems, for example, in-plain switching (IPS) mode may be employed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A driving method of a display device comprising:

a plurality of sets of columns, the plurality of sets of columns each comprising three columns of a first column of first color pixels, a second column of second color pixels, and a third column of third color pixels and fourth color pixels arranged alternately, and being arranged along a first direction which crosses a second direction;

first sets each including a first color pixel in the first column, a second color pixel in the second column, and one of a third color pixel and a fourth color pixel in the third column, the first color pixel, the second color pixel, and the one of the third color pixel and the fourth color pixel being arranged along the first direction, and second sets, which are adjacent to the first sets in the first direction, each including a first color pixel in the first column, a second color pixel in the second column, and one of a fourth color pixel and a third color pixel in the third column, the first color pixel, the second color pixel, and the one of the fourth color pixel and the third color pixel being arranged along the first direction, each of the first sets including the third color pixel when an adjacent one of the second sets includes the fourth color pixel, and including the fourth color pixel when the adjacent one of the second sets includes the third color pixel;

a first composite color column of a first composite color unit pixel being defined by arranging the first sets along the second direction, and a second composite color column of a second composite color unit pixel being defined by arranging the second sets along the second direction, the first composite color column and the second composite color column being repeatedly provided along the first direction;

gate lines comprising odd-numbered and even-numbered gate lines, arranged to corresponds to color pixels of odd-numbered rows and even-numbered rows; and a common electrode, the driving method comprising:

supplying pixel signals to the pixels of the first columns, the second columns, and the third columns in a pattern in which polarities of the pixel signals of the first column and the second column in the first composite color column are different from each other, polarities of the pixel signals of the first columns in the first composite color column and the second composite color column are different from each other, polarities of the pixel signals of the second columns in the first composite color column and the second composite color column are different from each other, and polarities of the pixel signals of the third columns are reversed every two composite color columns.

2. The driving method of claim 1, wherein the first color pixel is a red pixel, the second color pixel is a green pixel, the third color pixel is a blue pixel and the fourth color pixel is a white pixel.

3. The driving method of claim 1, wherein a pattern of polarities of the pixel signals of the pixels of the third columns along the first direction with respect to the common electrode for a first frame is: . . . , +, +, −, −, +, +, −, −, +, +, −, −, . . . , and a pattern of polarities of the pixel signals of the pixels of the third columns along the first direction with respect to the common electrode for a following second frame is inverted to that of the first frame.

4. The driving method of claim 1, wherein the pixels of the first columns are red pixels, and the supplying pixel signals comprises supplying pixel signals to the red pixels in a pattern that polarities of the pixel signals of the red pixels along the first direction with respect to the common electrode are: . . . , +, −, +, −, +, −, . . . .

5. The driving method of claim 1, wherein the pixels of the second columns are green pixels, and the supplying pixel signals comprises supplying pixel signals to the green pixels in a pattern that polarities of the pixel signals of the green pixels along the first direction with respect to the common electrode are: . . . , −,+, −, +, −, +, . . . , such that each green pixel and each respective red pixel located as an adjacent pair have different polarities.

6. The driving method of claim 1, further comprising:

preparing first pixel signals to be supplied to the pixels of the first columns, second pixel signals to be supplied to the pixels of the second columns, and third pixel signals to be supplied to the pixels of the third columns, as two types of pixel signals of a positive polarity and a negative polarity with respect to that of the common electrode; and selecting one of the two types of pixel signals, and outputting the selected one as the first pixel signal, the second pixel signal or the third pixel signal.

7. A display device comprising:

a plurality of sets of columns, the plurality of sets of columns each comprising three columns of a first column of first color pixels, a second column of second color pixels, and a third column of third color pixels and fourth color pixels arranged alternately, and being arranged along a first direction which crosses a second direction;

first sets each including a first color pixel in the first column, a second color pixel in the second column, and one of a third color pixel and a fourth color pixel in the third column, the first color pixel, the second color pixel, the one of the third color pixel and the fourth color pixel being arranged along the first direction, and second sets, which are adjacent to the first sets in the first direction, each including a first color pixel in the first column, a second color pixel in the second column, and one of a fourth color pixel and a third color pixel in the third column, the first color pixel, the second color pixel, the one of the fourth color pixel and the third color pixel being arranged along the first direction, each of the first sets including the third color pixel when an adjacent one of the second sets includes the fourth color pixel, and including the fourth color pixel when the adjacent one of the second sets includes the third color pixel;

a first composite color column of a first composite color unit pixel being defined by arranging the first sets along the second direction, and a second composite color column of a second composite color unit pixel being defined by arranging the second sets along the second direction, the first composite color column and the second composite color column being repeatedly provided along the first direction;

gate lines comprising odd-numbered and even-numbered gate lines, arranged to corresponds to color pixels of odd-numbered rows and even-numbered rows;

a common electrode; and a driver configured to:

supply pixel signals to the pixels of the first columns, the second columns, and the third columns in a pattern in which polarities of the pixel signals of the first column and the second column in the first composite color column are different from each other, polarities of the pixel signals of the first columns in the first composite color column and the second composite color column are different from each other, polarities of the pixel signals of the second columns in the first composite color column and the second composite color column are different from each other, and polarities of the pixel signals of the third columns are reversed every two composite color columns.

8. The display device of claim 7, wherein the first color pixel is a red pixel, the second color pixel is a green pixel, the third color pixel is a blue pixel and the fourth color pixel is a white pixel.

9. The display device of claim 7, wherein the driver is configured to output, for a first frame, the pixel signals in a pattern of polarities of the pixel signals of the pixels of the third columns along the first direction with respect to the common electrode is:. . . , +, +, −, −, +, +, −, −, +, +, −, −, . . . , and for a following second frame, in a pattern of polarities of the pixel signals of the pixels of the third columns, which is inverted to that of the first frame.

10. The display device of claim 7, wherein the pixels of the first columns are red pixels, and the driver is configured to supply pixel signals to the red pixels in a pattern that polarities of the pixel signals of the red pixels along the first direction with respect to the common electrode are: . . . , +, −, +, −, +, −, . . . .

11. The display device of claim 7, wherein the pixels of the second columns are green pixels, and the driver is configured to supply pixel signals to the green pixels in a pattern that polarities of the pixel signals of the green pixels along the first direction with respect to the common electrode are: . . . , −, +, −, +, −, +, . . . , such that each green pixel and each respective red pixel located as an adjacent pair have different polarities.

12. The display device of claim 7, further comprising:

a circuit configured to prepare first pixel signals to be supplied to the pixels of the first columns, second pixel signals to be supplied to the pixels of the second columns, and third pixel signals to be supplied to the pixels of the third columns, as two types of pixel signals of a positive polarity and a negative polarity with respect to that of the common electrode; and a switch configured to select one of the two types of pixel signals and output the selected one as the first pixel signal, the second pixel signal or the third pixel signal.

* * * * *